US009816444B2

(12) United States Patent
Kitagawa

(10) Patent No.: US 9,816,444 B2
(45) Date of Patent: Nov. 14, 2017

(54) CONTROL APPARATUS FOR INTERNAL COMBUSTION ENGINE

(71) Applicant: TOYOTA JIDOSHA KABUSHIKI KAISHA, Toyota-shi, Aichi-ken (JP)

(72) Inventor: Eiki Kitagawa, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/226,162

(22) Filed: Aug. 2, 2016

(65) Prior Publication Data

US 2017/0037791 A1 Feb. 9, 2017

(30) Foreign Application Priority Data

Aug. 4, 2015 (JP) ..... 2015-154335

(51) Int. Cl.
*F02D 35/02* (2006.01)
*F02D 41/28* (2006.01)
(Continued)

(52) U.S. Cl.
CPC ..... *F02D 35/023* (2013.01); *F02D 35/028* (2013.01); *F02D 41/28* (2013.01);
(Continued)

(58) Field of Classification Search
CPC ..... F02D 35/023; F02D 41/28; F02D 35/028; F02D 41/38; F02D 41/008; F02D 41/22; F02D 2041/228; F02D 2041/286; F02D 2041/1418; F02D 41/1401; F02D 37/02; F02D 41/1488; F02P 5/1512; F02P 5/045; G01L 19/04; G01L 23/24
See application file for complete search history.

(56) References Cited

U.S. PATENT DOCUMENTS

2008/0319632 A1 12/2008 Miyashita et al.
2010/0241333 A1* 9/2010 Moriya ..... F02D 11/10 701/101
(Continued)

FOREIGN PATENT DOCUMENTS

JP 2008-069713 A 3/2008
JP 2016133011 A 7/2016
(Continued)

*Primary Examiner* — Hung Q Nguyen
*Assistant Examiner* — Xiao Mo
(74) *Attorney, Agent, or Firm* — Andrews Kurth Kenyon LLP

(57) ABSTRACT

A control apparatus for an internal combustion engine is configured to: calculate measured data of MFB based on in-cylinder pressure detected by an in-cylinder pressure sensor; execute engine control based on a measured value of a specified fraction combustion point that is calculated based on the measured data of MFB; and calculate a first correlation index value for the measured data (current data) and the reference data of MFB and a second correlation index value for the current data and the immediately preceding past data. The engine control is suspended that uses the measured data of the specified fraction combustion point based on the current data when both of the first correlation index value and the second correlation index value are less than a determination value.

8 Claims, 7 Drawing Sheets

(51) Int. Cl.

| | |
|---|---|
| *F02D 41/00* | (2006.01) |
| *F02D 41/14* | (2006.01) |
| *F02D 41/22* | (2006.01) |
| *F02D 41/38* | (2006.01) |
| *F02P 5/04* | (2006.01) |
| *F02P 5/15* | (2006.01) |
| *F02D 37/02* | (2006.01) |

(52) U.S. Cl.

CPC ..... *F02D 37/02* (2013.01); *F02D 41/008* (2013.01); *F02D 41/1401* (2013.01); *F02D 41/22* (2013.01); *F02D 41/38* (2013.01); *F02D 2041/1418* (2013.01); *F02D 2041/228* (2013.01); *F02D 2041/286* (2013.01); *F02P 5/045* (2013.01); *F02P 5/1512* (2013.01)

(56) References Cited

U.S. PATENT DOCUMENTS

| | | | | |
|---|---|---|---|---|
| 2016/0123247 | A1* | 5/2016 | Mizoguchi | B60W 10/06 123/406.55 |
| 2016/0160776 | A1* | 6/2016 | Yeager | F02D 35/023 123/435 |
| 2016/0237923 | A1* | 8/2016 | Kitagawa | F02D 35/023 |
| 2016/0369727 | A1* | 12/2016 | Kitagawa | F02D 41/30 |
| 2017/0022911 | A1* | 1/2017 | Kitagawa | F02D 35/023 |
| 2017/0030283 | A1* | 2/2017 | Sasaki | F02D 35/028 |
| 2017/0037791 | A1* | 2/2017 | Kitagawa | F02D 35/023 |

FOREIGN PATENT DOCUMENTS

| | | | |
|---|---|---|---|
| WO | 2016/113787 | A1 | 7/2016 |
| WO | 2016/132197 | A1 | 8/2016 |

* cited by examiner

| | IR1 | IR2 | |
|---|---|---|---|
| Example 1 | Large | Large | Noise is not superimposed |
| Example 2 | Large | Small | Noise is incidentally superimposed on preceding combustion wavefom |
| Example 3 | Small | Large | Noise is steadily superimposed |
| Example 4 | Small | Small | Noise is incidentally superimposed on current combustion wavefom |

CONTROL APPARATUS FOR INTERNAL COMBUSTION ENGINE

CROSS-REFERENCE TO RELATED APPLICATION

The present application claims priority to Japanese Patent Application No. 2015-154335 filed on Aug. 4, 2015, which is incorporated herein by reference in its entirety.

BACKGROUND

Technical Field

Embodiments of the present disclosure relate to a control apparatus for an internal combustion engine, and more particularly to a control apparatus for an internal combustion engine that is suitable as an apparatus for controlling an internal combustion engine that includes an in-cylinder pressure sensor.

Background Art

In JP 2008-069713A, a combustion control apparatus for an internal combustion engine that includes an in-cylinder pressure sensor is disclosed. In the combustion control apparatus, data of mass fraction burned that is synchronized with a crank angle is calculated using an in-cylinder pressure sensor and a crank angle sensor, and an actual combustion start point and a combustion center are calculated based on the data. In addition, if a difference obtained by subtracting the actual combustion start point from the combustion center exceeds an upper limit, the combustion control apparatus determines that combustion has deteriorated, and implements a countermeasure for improving combustion, such as increasing the fuel injection amount. Note that, in JP 2008-069713A, as one example, an appropriate value in a period in which mass fraction burned is from 10 to 30 percent is used as the aforementioned actual combustion start point that is a crank angle at which combustion is actually started in a cylinder, and, for example, an appropriate value in a period in which mass fraction burned is from 40 to 60 percent is used as the combustion center.

JP 2008-069713A is a patent document which may be related to the present disclosure.

Technical Problem

Noise may be superimposed on an output signal of an in-cylinder pressure sensor due to various factors. Where engine control is performed based on a crank angle at which mass fraction burned (MFB) reaches a specified mass fraction burned (hereunder, the crank angle is referred to as a "specified fraction combustion point") as disclosed in JP 2008-069713A, the specified fraction combustion point is calculated based on measured data of MFB. If noise is superimposed on an output signal of the in-cylinder pressure sensor, noise is also superimposed on the measured data of MFB that is based on measured data of the in-cylinder pressure. Consequently, an error that is caused by noise may arise with respect to a specified fraction combustion point that is utilized for engine control. If engine control based on a specified fraction combustion point is performed without giving any particular consideration to this kind of noise, there is a possibility that the accuracy of the engine control will deteriorate. Therefore, where engine control based on a specified fraction combustion point is performed, it is necessary to adopt a configuration that can appropriately detect that noise is superimposed on measured data of MFB, and to also ensure that an appropriate countermeasure is implemented when noise is detected.

With respect to detection of noise as described above, the present inventor has already studied a determination method that is based on a correlation index value that indicates the degree of correlation between measured data of MFB and reference data of MFB that is based on the operating condition of the internal combustion engine, and has obtained confirmation that the determination method is effective. However, further studies of the present inventor have revealed that it is difficult to determine whether the noise which has been detected is temporal or is steadily (and continuously) occurring by comparing current data of the measured data of MFB and reference data of MFB in a combustion cycle.

If a determination cannot be made as to whether noise is temporal or steady, it is conceivable that a countermeasure prepared for a steadily occurring noise may be performed even if the noise is temporal in practice. This countermeasure for a steadily occurring noise is not necessary for combustion cycles performed after temporal noise disappears. In addition, there is a possibility that execution of such an unnecessary countermeasure may cause adverse effects, such as deterioration of exhaust emissions, on engine control.

SUMMARY

Embodiments of the present disclosure address the above-described problem and have an object to provide a control apparatus for an internal combustion engine that can detect noise which is superimposed on measured data of mass fraction burned calculated based on an output of an in-cylinder pressure sensor while determining whether the noise that is detected is temporal or steady, and can perform a change of engine control as a countermeasure suitable for when the detected noise is temporal.

A control apparatus for an internal combustion engine according to the present disclosure includes: an in-cylinder pressure sensor configured to detect an in-cylinder pressure; a crank angle sensor configured to detect a crank angle; and a controller. The controller is programmed to: calculate measured data of mass fraction burned that is synchronized with crank angle, based on an in-cylinder pressure detected by the in-cylinder pressure sensor and a crank angle detected by the crank angle sensor; calculate, based on the measured data of mass fraction burned, a measured value of a specified fraction combustion point that is a crank angle at which mass fraction burned reaches a specified fraction, and to execute engine control that controls an actuator of the internal combustion engine based on the measured value of the specified fraction combustion point; calculate a first correlation index value that indicates a degree of correlation between current data of the measured data of mass fraction burned and reference data of mass fraction burned, the reference data of mass fraction burned being based on an operating condition of the internal combustion engine; and calculate a second correlation index value that indicates a degree of correlation between the current data and immediately preceding past data relative to the current data. The controller is also programmed, when the first correlation index value is less than a first determination value and the second correlation index value is less than a second determination value, to perform a change of the engine control. The change of the engine control is to prohibit reflection, in the engine control, of the measured value of the specified fraction combustion point in a combustion cycle in which the current data of the mass fraction burned is calculated, or to lower a degree of the reflection in comparison to that when the first correlation index value is greater than or equal to the first determination value.

The engine control may control the actuator so that the measured value of the specified fraction combustion point or a measured value of a specified parameter that is defined based on the measured value of the specified fraction combustion point comes close to a target value. The controller may be programmed to execute a countermeasure against noise that is superimposed on an output signal of the in-cylinder pressure sensor when the first correlation index value is less than the first determination value and the second correlation index value is greater than or equal to the second determination value. Further, the countermeasure may be to change the target value so that a difference between the measured value of the specified fraction combustion point or the measured value of the specified parameter and the target value decreases.

The controller may be programmed to execute a countermeasure against noise that is superimposed on an output signal of the in-cylinder pressure sensor when the first correlation index value is less than the first determination value and the second correlation index value is greater than or equal to the second determination value. Further, the countermeasure may be to increase a period of performing the change of the engine control when the first correlation index value is less than the first determination value and the second correlation index value is greater than or equal to the second determination value, in comparison to that when the first correlation index value is less than the first determination value and the second correlation index value is less than the second determination value.

The countermeasure may be executed when the number of times that a determination that the first correlation index value is less than the first determination value and the second correlation index value is greater than or equal to the second determination value is continuously made becomes greater than a predetermined number of times.

The controller may be programmed to calculate the second correlation index value by using, as the immediately preceding past data, the measured data of mass fraction burned that is calculated, at a same cylinder, in a combustion cycle that is one cycle prior to a combustion cycle in which the current data of mass fraction burned is calculated.

The in-cylinder pressure sensor may be configured to detect an in-cylinder pressure for each cylinder of a plurality of cylinders. Further, the controller may be programmed to calculate the second correlation index value by using, as the immediately preceding past data, the measured data of mass fraction burned that is calculated, at a same cylinder, in a combustion cycle of another cylinder during a period from a combustion cycle that is one cycle prior to a combustion cycle in which the current data of mass fraction burned is calculated until a combustion cycle in which the current data of mass fraction burned is calculated.

The another cylinder may be a cylinder that, in a firing order, is positioned one place before a cylinder in whose combustion cycle the current data of mass fraction burned is calculated.

According to the control apparatus for an internal combustion engine of the present disclosure, a first correlation index value is calculated that indicates the degree of correlation between current data of measured data of mass fraction burned based on in-cylinder pressure detected by an in-cylinder pressure sensor and reference data of mass fraction burned based on an operating condition of the internal combustion engine. If noise is superimposed on the measured data (current data) of mass fraction burned, the first correlation index value becomes smaller (that is, the first correlation index value indicates that the degree of the correlation is low). According to the control apparatus, noise superimposed on the measured data of mass fraction burned can therefore be detected using the first correlation index value. In addition, according to the control apparatus, a second correlation index value that indicates the degree of correlation between the current data and immediately preceding past data is calculated. If the noise which has been detected is a temporally occurring noise, both of the first and second correlation index values become smaller. If, on the other hand, the noise that has been detected is a steadily occurring noise, the first correlation index value becomes smaller while the second correlation index value becomes larger. Thus, by evaluating the magnitude of each of the first and second correlation index values, the noise can be detected while discriminating a temporally occurring noise from a steadily occurring noise. Further, according to the control apparatus, when the first correlation index value is less than a first determination value and the second correlation index value is less than a second determination value (that is, when it can be judged that noise has temporally occurred), a change of engine control for controlling an actuator of the internal combustion engine based on a measured value of a specified fraction combustion point is performed. More specifically, this change of the engine control is performed in such a manner as to prohibit reflection, in the engine control, of the measured value of the specified fraction combustion point in a combustion cycle in which the current data of the mass fraction burned that is used for determination that noise is superimposed is calculated, or to lower the degree of the reflection in comparison to that when the first correlation index value is greater than or equal to the first determination value. According to the change of the engine control, an error of the specified fraction combustion point due to noise can be prevented from being reflected in the engine control without no change. As a result, a change of engine control can be performed as a countermeasure that is appropriate when noise which has been detected is a temporally occurring noise.

DETAILED DESCRIPTION

First Embodiment

Firstly, a first embodiment of the present disclosure will be described with reference to FIG. 1 to FIG. 9.

[System Configuration of First Embodiment]

Figure 1:
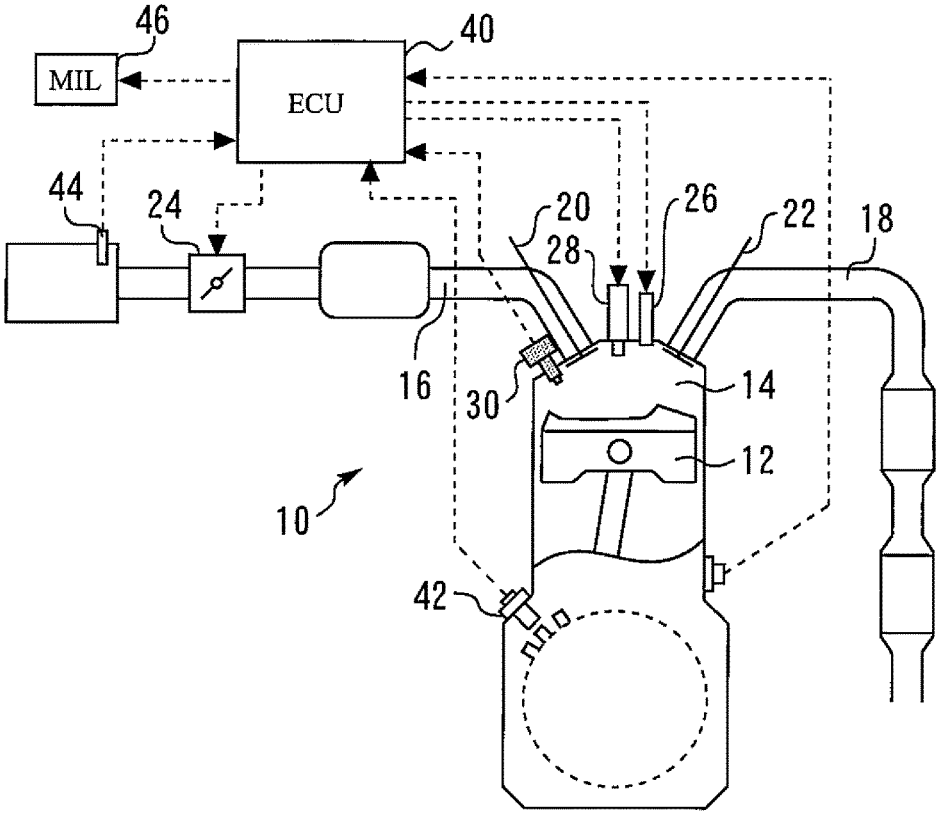
FIG. 1 is a view for describing a system configuration according to a first embodiment of the present disclosure.

FIG. 1 is a view for describing a system configuration according to a first embodiment of the present disclosure. The system shown in FIG. 1 includes a spark-ignition type internal combustion engine 10. A piston 12 is provided in each cylinder of the internal combustion engine 10. A combustion chamber 14 is formed on the top side of the piston 12 inside the respective cylinders. An intake passage 16 and an exhaust passage 18 communicate with the combustion chamber 14.

An intake valve 20 is provided in an intake port of the intake passage 16. The intake valve 20 opens and closes the intake port. An exhaust valve 22 is provided in an exhaust port of the exhaust passage 18. The exhaust valve 22 opens and closes the exhaust port. An electronically controlled throttle valve 24 is provided in the intake passage 16. Each cylinder of the internal combustion engine 10 is provided with a fuel injection valve 26 for injecting fuel directly into the combustion chamber 14 (into the cylinder), and an ignition device (only a spark plug is illustrated in the drawings) 28 for igniting an air-fuel mixture. An in-cylinder pressure sensor 30 for detecting an in-cylinder pressure is also mounted in each cylinder.

The system of the present embodiment also includes a control apparatus that controls the internal combustion engine 10. The control apparatus includes an electronic control unit (ECU) 40, drive circuits (not shown in the drawings) for driving various actuators and various sensors that are described below and the like, as a control apparatus that controls the internal combustion engine 10. The ECU 40 includes an input/output interface, a memory, and a central processing unit (CPU). The input/output interface is configured to receive sensor signals from various sensors installed in the internal combustion engine 10 or the vehicle in which the internal combustion engine 10 is mounted, and to also output actuating signals to various actuators for controlling the internal combustion engine 10. Various control programs and maps for controlling the internal combustion engine 10 are stored in the memory. The CPU reads out a control program or the like from the memory and executes the control program, and generates actuating signals for various actuators based on the received sensor signals.

The sensors from which the ECU 40 receives signals include, in addition to the aforementioned in-cylinder pressure sensor 30, various sensors for acquiring the engine operating state such as a crank angle sensor 42 that is arranged in the vicinity of a crank shaft (not illustrated in the drawings), and an air flow sensor 44 that is arranged in the vicinity of an inlet of the intake passage 16.

The actuators to which the ECU 40 outputs actuating signals include various actuators for controlling operation of the engine such as the above described throttle valve 24, fuel injection valve 26 and ignition device 28. Moreover, a malfunction indicator lamp (MIL) 46 for notifying the driver of the occurrence of malfunction about the in-cylinder pressure sensor 30 is connected to the ECU 40. The ECU 40 also has a function that synchronizes an output signal of the in-cylinder pressure sensor 30 with a crank angle, and subjects the synchronized signal to AD conversion and acquires the resulting signal. It is thereby possible to detect an in-cylinder pressure at an arbitrary crank angle timing in a range allowed by the AD conversion resolution. In addition, the ECU 40 stores a map in which the relation between a crank angle and an in-cylinder volume is defined, and can refer to the map to calculate an in-cylinder volume that corresponds to a crank angle.

[Engine Control in First Embodiment]

(Calculation of Measured Data of MFB Utilizing in-Cylinder Pressure Sensor)

Figure 2:
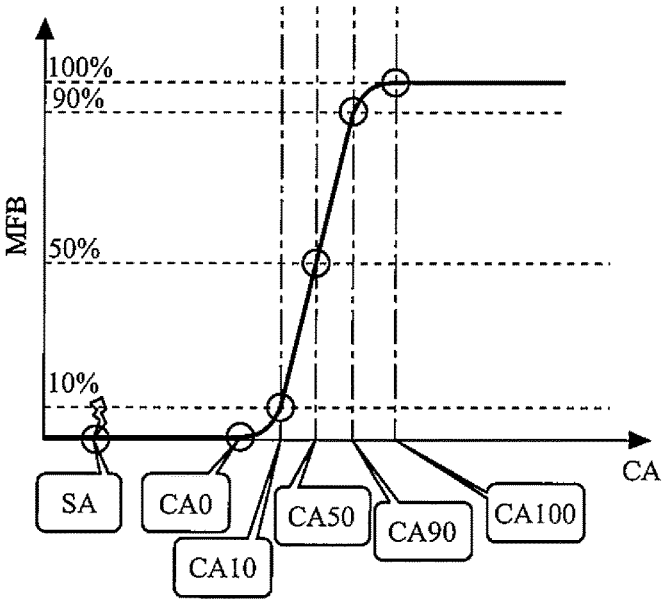
FIG. 2 is a view that represents a waveform of mass fraction burned (MFB) and a spark timing (SA)

FIG. 2 is a view that represents a waveform of mass fraction burned (MFB) and a spark timing (SA). According to the system of the present embodiment that includes the in-cylinder pressure sensor 30 and the crank angle sensor 42, in each cycle of the internal combustion engine 10, measured data of an in-cylinder pressure P can be acquired in synchrony with a crank angle (more specifically, a set of in-cylinder pressures P that are calculated as values for the respective predetermined crank angles). A heat release amount Q inside a cylinder at an arbitrary crank angle θ can be calculated according to the following equations (1) and (2) using the measured data of the in-cylinder pressure P and the first law of thermodynamics. Furthermore, a mass fraction burned (hereunder, referred to as "MFB") at an arbitrary crank angle θ can be calculated in accordance with the following equation (3) using the measured data of the heat release amount Q inside a cylinder (more specifically, a set of heat release amounts Q calculated as values for the respective predetermined crank angles). Further, measured data of MFB (measured MFB set) that is synchronized with the crank angle can be calculated by executing processing to calculate the MFB at each predetermined crank angle. The measured data of MFB is calculated in a combustion period and in a predetermined crank angle period before and after the combustion period (here, as one example, the crank angle period is from a closing timing IVC of the intake valve 20 to an opening timing EVO of the exhaust valve 22).

$$dQ/d\theta = \frac{1}{\kappa - 1} \times \left( V \times \frac{dP}{d\theta} + P \times \kappa \times \frac{dV}{d\theta} \right) \tag{1}$$

$$Q = \sum \frac{dQ}{d\theta} \tag{2}$$

$$MFB = \frac{Q(\theta) - Q(\theta_{min})}{Q(\theta_{max}) - Q(\theta_{min})} \times 100 \tag{3}$$

Where, in the above equation (1), V represents an in-cylinder volume and κ represents a ratio of specific heat of in-cylinder gas. Further, in the above equation (3), $\theta_{min}$ represents a combustion start point and $\theta_{max}$ represents a combustion end point.

According to the measured data of MFB that is calculated by the above method, a crank angle at which MFB reaches a specified fraction α (%) (hereunder, referred to as "specified fraction combustion point", and indicated by attaching "CAα") can be acquired. More specifically, when acquiring the specified fraction combustion point CAα, although there is a possibility that a value of the specified fraction α is successfully included in the measured data of MFB, where the value is not included, the specified fraction combustion point CAα can be calculated by interpolation based on measured data located on both sides of the specified fraction α. Hereunder, in the present description, a value of CAα that is acquired utilizing measured data of MFB is referred to as a "measured CAα". A typical specified fraction combustion point CAα will now be described with reference to FIG. 2. Combustion in a cylinder starts with an ignition delay after igniting an air-fuel mixture is performed at the spark timing (SA). A start point of the combustion ($\theta_{min}$ in the above described equation (3)), that is, a crank angle at which MFB starts to rise is referred to as "CA0". A crank angle period (CA0-CA10) from CA0 until a crank angle CA10 at which MFB reaches 10% corresponds to an initial combustion period, and a crank angle period (CA10-CA90) from CA10 until a crank angle CA90 at which MFB reaches 90% corresponds to a main combustion period. Further, according to the present embodiment, a crank angle CA50 at which MFB reaches 50% is used as a combustion center. A crank angle CA100 at which MFB reaches 100% corresponds to a combustion end point ($\theta_{max}$ in the above described equation (3)) at which the heat release amount Q reaches a maximum value. The combustion period is defined as a crank angle period from CA0 to CA100.

(Engine Control Utilizing CAα)

Figure 3:
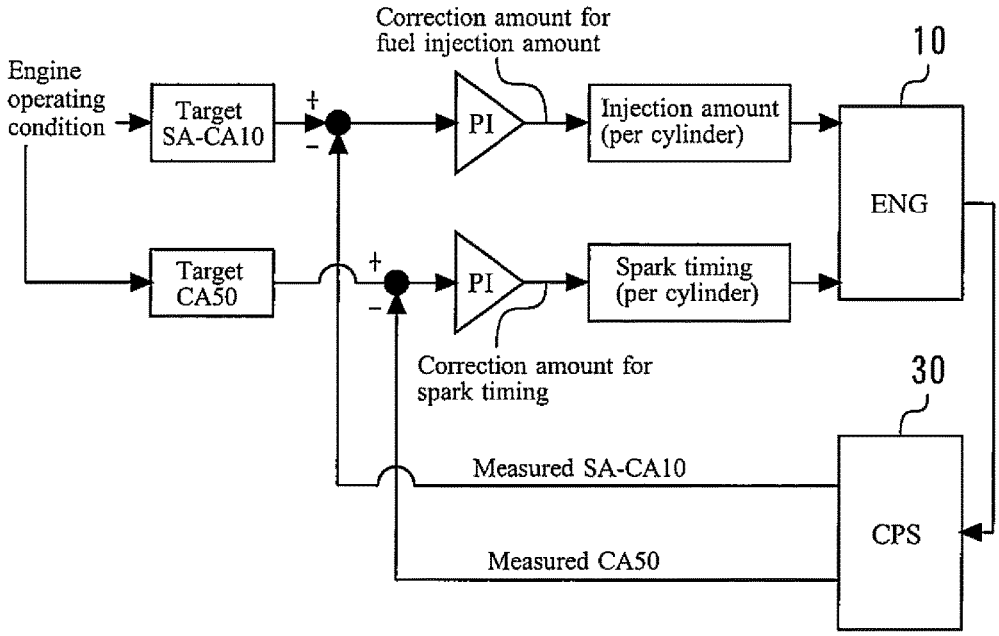
FIG. 3 is a block diagram for describing an outline of two types of feedback control utilizing CA10 and CA50 that an ECU executes.

FIG. 3 is a block diagram for describing an outline of two types of feedback control utilizing CA10 and CA50 that the ECU 40 executes. The engine control that the ECU 40 performs includes control utilizing a specified fraction combustion point CAα. Here, as examples of engine control utilizing a specified fraction combustion point CAα, two types of feedback control that utilize CA10 and CA50, respectively, will be described. According to the present embodiment, these controls are executed during lean-burn operation that is performed at a larger (leaner) air-fuel ratio than the stoichiometric air-fuel ratio.

1. Feedback Control of Fuel Injection Amount Utilizing SA-CA10

In this feedback control, CA10 that is the 10% combustion point is not taken as a direct target value, but is instead utilized as follows. That is, in the present description, a crank angle period from the spark timing SA to CA10 is referred to as "SA-CA10". More specifically, SA-CA10 that is a difference obtained by subtracting the spark timing SA from the measured CA10 is referred to as a "measured SA-CA10". Note that, according to the present embodiment, a final target spark timing (command value of spark timing in the next cycle) after adjustment by feedback control of the spark timing utilizing CA50 as described later is used as the spark timing SA that is used for calculating the measured SA-CA10.

Figure 4:
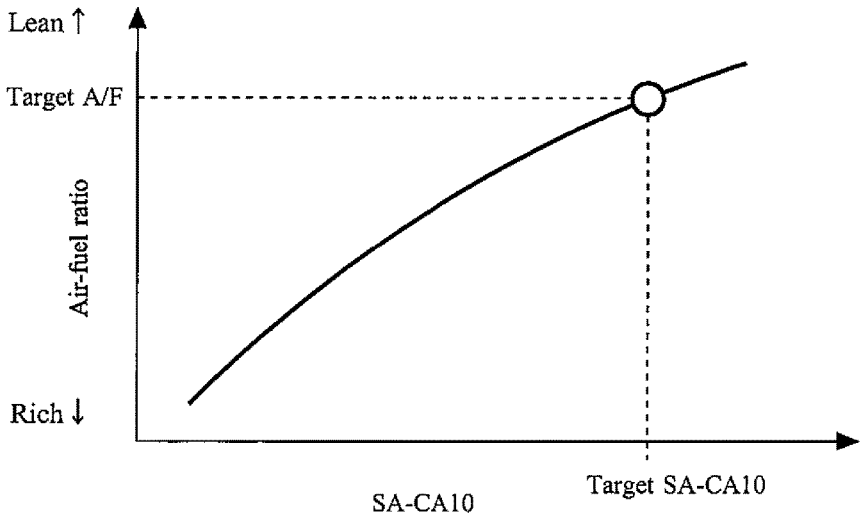
FIG. 4 is a view that represents a relation between the air-fuel ratio and SA-CA10.

FIG. 4 is a view that represents a relation between the air-fuel ratio and SA-CA10. This relation is for a lean air-fuel ratio region that is on a lean side relative to the stoichiometric air-fuel ratio, and under an identical operating condition (more specifically, an engine operating condition in which the intake air amount and engine speed are identical). SA-CA10 is a parameter that represents an ignition delay, and there is a correlation between SA-CA10 and the air-fuel ratio. More specifically, as shown in FIG. 4, in the lean air-fuel ratio region, there is a relation that SA-CA10 increases as the air-fuel ratio becomes leaner. Therefore, a target SA-CA10 that corresponds to a desired target air-fuel ratio can be determined by defining the relation in advance. In addition, according to the present embodiment a configuration is adopted so that, during lean-burn operation, feedback control is executed that adjusts a fuel injection amount so that the measured SA-CA10 comes close to the target SA-CA10 (hereunder, referred to simply as "SA-CA10 feedback control").

As shown in FIG. 3, in the SA-CA10 feedback control the target SA-CA10 is set in accordance with the engine operating condition (more specifically, the target air-fuel ratio, the engine speed and the intake air amount). The measured SA-CA10 is calculated for each cycle in the respective cylinders. Further, in the SA-CA10 feedback control, as one example, PI control is used to adjust the fuel injection amount so that a difference between the target SA-CA10 and the measured SA-CA10 is eliminated. In the PI control, using a difference between the target SA-CA10 and the measured SA-CA10 as well as a predetermined PI gain (proportional gain and integral gain), a correction amount for the fuel injection amount is calculated in accordance with the difference and the size of an integrated value thereof. A correction amount that is calculated for each cylinder is reflected in the basic fuel injection amount of the cylinder that is an object of adjustment. In this way, the fuel injection amount to be supplied in the next cycle at the cylinder is adjusted (corrected) by the SA-CA10 feedback control.

According to the SA-CA10 feedback control, in a cylinder in which a measured SA-CA10 that is less than the target SA-CA10 is obtained, correction is executed that decreases the fuel injection amount to be used in the next cycle to thereby make the air-fuel ratio leaner and increase the measured SA-CA10. Conversely, in a cylinder in which a measured SA-CA10 that is greater than the target SA-CA10 is obtained, correction is executed that increases the fuel injection amount to be used in the next cycle to thereby make the air-fuel ratio richer and decrease the measured SA-CA10.

According to the SA-CA10 feedback control, by utilizing SA-CA10 that is a parameter that has a high correlation with the air-fuel ratio, the air-fuel ratio during lean-burn operation can be controlled to a target value (target air-fuel ratio). Consequently, by setting the target SA-CA10 to a value corresponding to an air-fuel ratio in the vicinity of a lean combustion limit, the air-fuel ratio can be controlled in the vicinity of the lean limit. By this means, low fuel efficiency and low NOx emissions can be realized.

2. Feedback Control of Spark Timing Utilizing CA50

The optimal spark timing (so-called "MBT (minimum advance for the best torque) spark timing") changes according to the air-fuel ratio. Therefore, if the air-fuel ratio changes as a result of the SA-CA10 feedback control, the MBT spark timing will also change. On the other hand, CA50 at which the MBT spark timing is obtained substantially does not change with respect to the air-fuel ratio in the lean air-fuel ratio region. Therefore it can be said that, by adopting CA50 at which the MBT spark timing is obtained as a target CA50, and correcting the spark timing so that a difference between the measured CA50 and the target CA50 is eliminated, the spark timing at a time of lean-burn operation can be adjusted to the MBT spark timing without being affected by a change in the air-fuel ratio as described above. Therefore, according to the present embodiment a configuration is adopted that, during lean-burn operation, together with the SA-CA10 feedback control, also executes feedback control that adjusts the spark timing so that the measured CA50 comes close to the target CA50 (hereunder, referred to simply as "CA50 feedback control").

As shown in FIG. 3, in the CA50 feedback control, the target CA50 for making the spark timing the MBT spark timing is set to a value that is in accordance with the engine operating condition (more specifically, the target air-fuel ratio, the engine speed and the intake air amount). Note that, the term "CA50 feedback control" used herein is not necessarily limited to control that controls so as to obtain the MBT spark timing. That is, the CA50 feedback control can also be used when a spark timing other than the MBT spark timing is adopted as a target value, such as at a time of retarded combustion. In this example, for example, in addition to the above described engine operating condition, it is sufficient to set the target CA50 so as to change in accordance with a target ignition efficiency (that is, an index value indicating the degree of divergence of the target value from the MBT spark timing).

The measured CA50 is calculated for each cycle in the respective cylinders. Further, in the CA50 feedback control, as one example, PI control is used to correct the spark timing relative to the basic spark timing so that a difference between the target CA50 and the measured CA50 is eliminated. The basic spark timing is previously stored in the ECU 40 as a value that is in accordance with the engine operating condition (mainly, the intake air amount and engine speed). In the PI control, using a difference between the target CA50 and the measured CA50 as well as a predetermined PI gain (proportional gain and integral gain), a correction amount of the spark timing is calculated that is in accordance with the difference and the size of an integrated value of the difference. A correction amount that is calculated for each cylinder is reflected in the basic spark timing for the cylinder that is an object of adjustment. By this means, the spark timing (target spark timing) to be used in the next cycle at the cylinder is adjusted (corrected) by the CA50 feedback control.

Note that, the SA-CA10 feedback control and the CA50 feedback control are executed for each cylinder in the above described form.

[Noise Detection Technique and Countermeasure at Time of Noise Detection in First Embodiment]

(Influence of Noise on Measured Data of MFB)

Figure 5:
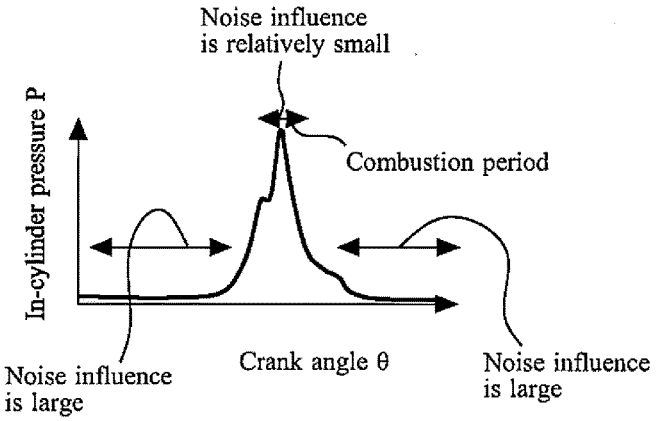
FIG. 5 is a P-θ diagram for describing differences in the degree of influence of noise with respect to respective locations of an in-cylinder pressure waveform during a single combustion cycle.

FIG. 5 is a P-θ diagram for describing differences in the degree of influence of noise with respect to respective locations of an in-cylinder pressure waveform during a single combustion cycle. Noise may sometimes be superimposed on an output signal of the in-cylinder pressure sensor 30 due to a variety of factors. However, as shown in FIG. 5, in the combustion period (CA0 to CA100) the influence of noise with respect to a measured waveform of the in-cylinder pressure during a single combustion cycle decreases in comparison to crank angle periods that are before and after the combustion period. The reason is that, in the combustion period and the vicinity thereof; the output value of the in-cylinder pressure sensor 30 is relatively large, and as a result the S/N ratio that is a ratio between the signal amount (signal) and noise amount (noise) increases. Furthermore, measured data of MFB that is calculated based on the output of the in-cylinder pressure sensor 30 is affected in the following manner by the influence of noise that is superimposed on an output signal of the in-cylinder pressure sensor 30.

More specifically, if noise is superimposed on an output signal of the in-cylinder pressure sensor 30, the influence of the noise appears on measured data of the heat release amount calculated based on the in-cylinder pressure and further on measured data of MFB. Because MFB data in a combustion period is based on high-pressure in-cylinder pressure data with respect to which the degree of influence of noise is low, it can be said that the MFB data in a combustion period is less susceptible to the influence of noise in comparison to measured data for MFB in crank angle periods before and after a combustion period. Furthermore, the following can be said in relation to the influence of noise with respect to a measured value of the specified fraction combustion point CAα that is calculated based on measured data of MFB. That is, a waveform of MFB data has a characteristic such that the waveform rises rectilinearly in the main combustion period (from CA10 to CA90). Therefore, it can be said that, fundamentally, it is difficult for an error due to noise to arise at the specified fraction combustion point CAα within the main combustion period. However, because of being affected by the influence of noise that is superimposed in the crank angle periods before and after the combustion period, an error that is caused by noise is liable to arise at the combustion starting point CA0 and the combustion end point CA100 that are locations at which the waveform of MFB data bends as well as at combustion points in the vicinity of the combustion start point CA0 and the combustion end point CA100 (from around CA0 to CA10, and from around CA90 to CA100) in comparison to other combustion points such as the combustion center (CA50) on the center side of the combustion period.

Figure 6:
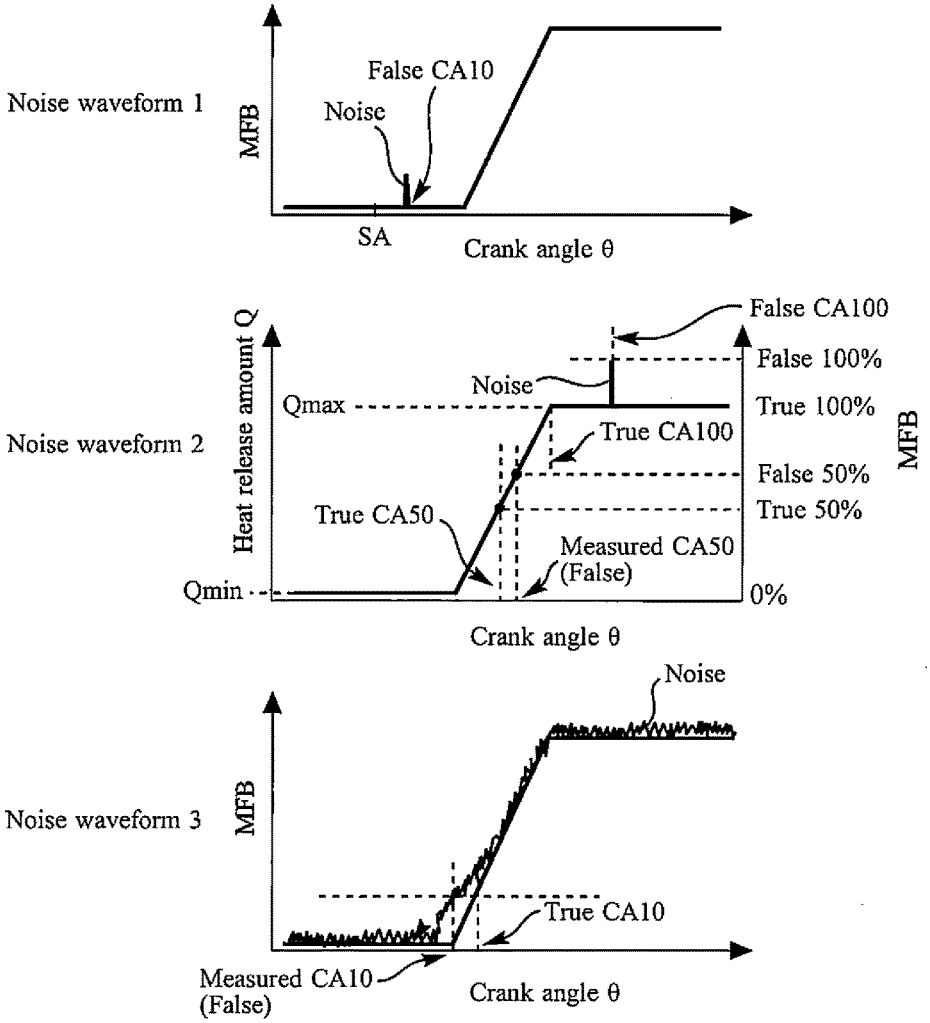
FIG. 6 is a view for describing kinds of noise that can be superimposed on a waveform of MFB data, and issues that are caused by the superimposition of noise.

FIG. 6 is a view for describing kinds of noise that can be superimposed on a waveform of MFB data, and issues that are caused by the superimposition of noise. A noise waveform 1 shown in FIG. 6 schematically illustrates a waveform of MFB data that is based on in-cylinder pressure data in which a large noise is superimposed in a spike shape at a crank angle timing that is after the spark timing SA in a crank angle period before the combustion period. If it is assumed that a waveform of measured data of MFB acquired during execution of the above described SA-CA10 feedback control is the noise waveform 1, there is a possibility that a crank angle in the vicinity of the data at which the spike-shaped noise is superimposed will be erroneously calculated as CA10.

A noise waveform 2 shown in FIG. 6 schematically illustrates a waveform of heat release amount data that is based on in-cylinder pressure data in which a large noise is superimposed in a spike shape in a crank angle period after a combustion period. The following issue arises when MFB data is calculated utilizing heat release amount data in which noise is superimposed in this manner. That is, there is a possibility that a value of the heat release amount data at the crank angle timing at which noise is superimposed will be erroneously recognized as a maximum heat release amount Qmax. This means that heat release amount data at which MFB reaches 100% will be erroneously determined. Consequently, an error will arise in calculation of CA100. Thus, an error caused by noise is liable to arise at CA100 as well as combustion points in the vicinity thereof due to receiving the influence of noise that is superimposed in a crank angle period after the combustion period. Although the influence of noise that is superimposed in the form shown in the noise waveform 2 decreases as the position of the combustion point is separated on the CA0 side from CA100, when the maximum heat release amount Qmax that serves as a basis for calculating MFB is erroneously determined, this causes an error to arise in the values of other combustion points also. More specifically, as also shown in the noise waveform 2 in FIG. 6, an error also arises at combustion points in the vicinity of the center of the combustion period, such as CA50, which are combustion points that, originally, it is difficult for the influence of noise to directly affect.

A noise waveform 3 shown in FIG. 6 schematically illustrates a waveform of MFB data that is based on in-cylinder pressure data in which the same level of noise is uniformly superimposed with respect to all of a combustion period and crank angle periods before and after the combustion period. Even when noise is superimposed over all of the combustion period and the crank angle periods before and after the combustion period in this manner, as long as the level of the superimposed noise is small, it can be said that even if the MFB data in which noise is superimposed is used for control, the control will not be affected thereby. However, the following issue arises when noise of a comparatively large level such as in the noise waveform 3 is superimposed over a wide range. That is, because an output value of the in-cylinder pressure sensor is a relative pressure, when performing combustion analysis such as calculating MFB data based on in-cylinder pressure data, prior to the combustion analysis a correction (absolute pressure correction) is generally performed that converts the output value of the in-cylinder pressure to an absolute pressure. Since the processing for the absolute pressure correction is known, a detailed description thereof is omitted herein. In the absolute pressure correction, in-cylinder pressure data at a predetermined two crank angles during the crank angle period before the combustion period is used. When noise is superimposed in the manner shown in noise waveform 3, an error is generated in the in-cylinder pressure data for the aforementioned two points that is used for the absolute pressure correction, and hence an error also arises in the absolute pressure correction amount. Such an error in the absolute pressure correction amount produces an error in the heat release amount data in such a way, for example, that a timing at which the heat release amount Q rises is earlier than the true timing. As a result, as also shown in the noise waveform in FIG. 6, a value at a combustion point in an initial stage of combustion, such as CA10, deviates relative to the true value. Further, an error in an absolute pressure correction amount may also affect a combustion point in the vicinity of the combustion end point CA100, such as CA90, and not just a combustion point in an initial stage of combustion, such as CA10.

(Noise Detection Techniques)

As illustrated by way of example referring to FIG. 6, the kind of noise that can be superimposed on an output signal of the in-cylinder pressure sensor 30 is not always the same. Further, when various usage environments of the internal combustion engine 10 are assumed, it is difficult to ascertain in advance when and in what form noise that has an influence on engine control will be superimposed on an output signal. However, in the example of performing the above described SA-CA10 feedback control and CA50 feedback control based on the output of the in-cylinder pressure sensor 30, it is suitable that it is possible to appropriately detect that noise is superimposed on measured data of MFB, and that an appropriate countermeasure is taken when noise is detected.

Figures 7, 8:
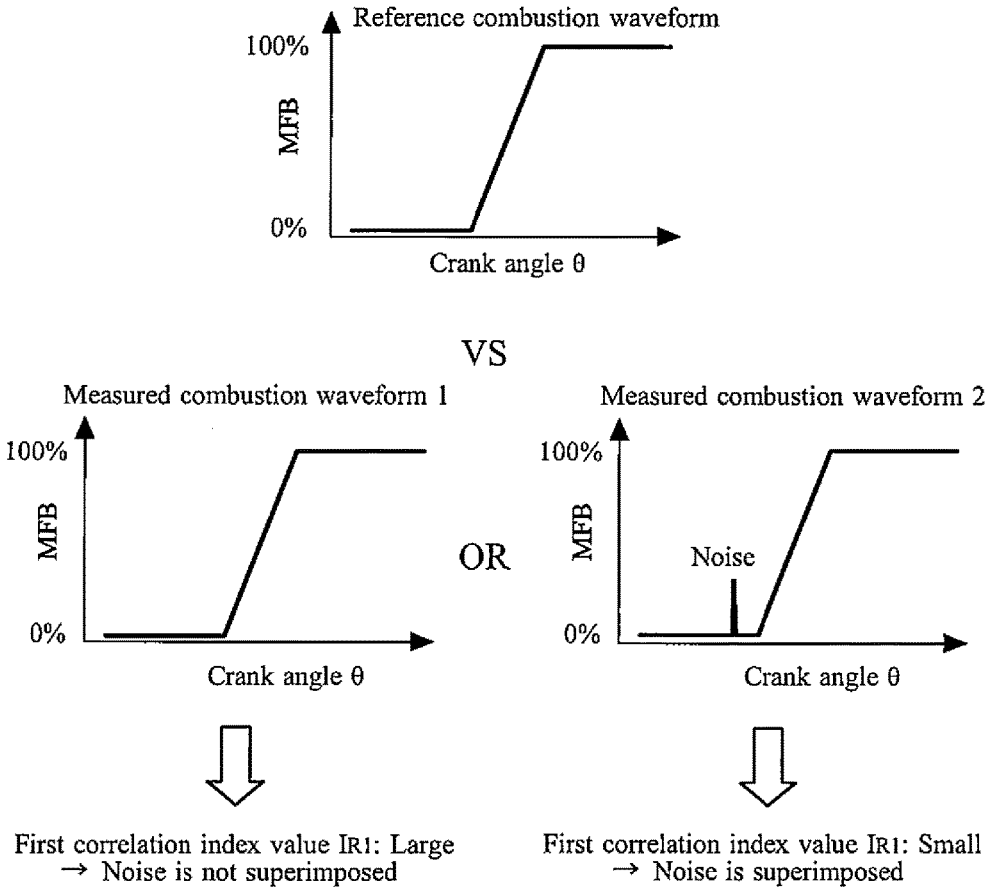
FIG. 7 is a view for describing a noise detection technique according to the first embodiment of the present disclosure.
FIG. 8 is a view that represents a relation of a first correlation index value and a second correlation index value with respect to the form of noise superimposition.

FIG. 7 is a view for describing a noise detection technique according to the first embodiment of the present disclosure. A reference combustion waveform shown in FIG. 7 schematically represents a waveform of reference data of MFB (that is, the ideal MFB data) that is based on the engine operating condition. A measured combustion waveform 1 and a measured combustion waveform 2 shown in FIG. 7 each schematically represent a waveform of measured data of MFB. More specifically, the measured combustion waveform 1 shows an example when noise is not superimposed, while the measured combustion waveform 2 shows an example when spike-shaped noise is superimposed during a crank angle period before the combustion period (CA0 to CA100).

If measured data of MFB is affected by the influence of noise, the measured data differs from the reference data of MFB at the same operating condition, which is not affected by the influence of this kind of noise. Accordingly, in the present embodiment, in order to detect that measured data of MFB is affected by the influence of noise, the magnitude of a "first correlation index value $I_{R1}$" that indicates the degree of correlation between reference data and measured data of MFB is evaluated. In addition, according to the present embodiment, a cross-correlation function is used as one example of a method for calculating the first correlation index value $I_{R1}$. Calculation of a cross-correlation coefficient R using a cross-correlation function is performed using the following equation (4).

$$R=\Sigma f_{a\sim b}(\theta)g_{a\sim b}(\tau_\theta-\theta) \tag{4}$$

Where, in the above equation (4), θ represents the crank angle. Further, $\tau_\theta$ is a variable that represents a relative deviation in a crank angle axis direction with respect to two waveforms that are objects for evaluation of the degree of correlation (in the present embodiment, the respective waveforms for reference data and measured data of MFB). A function $f_{a\sim b}(\theta)$ corresponds to reference data of MFB that is a set of discrete values that exists for each predetermined crank angle. A function $g_{a\sim b}(\tau_\theta-\theta)$ corresponds to measured data of MFB that, likewise, is a set of discrete values. More specifically, (a~b) indicates a period on the crank angle axis in which these functions $f_{a\sim b}(\theta)$ and $g_{a\sim b}(\tau_\theta-\theta)$ are respectively defined. The period (a~b) corresponds to a crank angle period (hereunder, referred to as a "calculation period T") in which reference data and measured data exist that are objects for calculation of the cross-correlation coefficient R (in other words, objects for evaluation of the degree of correlation) in the reference data and measured data of MFB. As one example, a period from a spark timing (SA) to an opening timing of the exhaust valve 22 (EVO) is used as the calculation period T. However, the whole or a part of a crank angle period from a closing timing of the intake valve 20 (IVO) to an opening timing of the exhaust valve 22 (EVO) can be used as the calculation period T. Note that, in an example where measured values of the specified fraction combustion points CAα (in the present embodiment, CA10 and CA50) that are used in the engine control are not included in the measured data of MFB that is calculated based on measured data of the in-cylinder pressure, a configuration may be adopted in which such a measured value is acquired by interpolation based on adjacent measured data, and a value on the reference data side that serves as a counterpart in a pair with the measured value is acquired, and the pair of values are included in the objects for evaluating the degree of correlation.

Performance of a convolution operation using equation (4) is accompanied by an operation that, by varying the variable $\tau_\theta$ within a predetermined range, consecutively calculates the cross-correlation coefficient R while causing the entire waveform of the measured data of MFB within the calculation period T to move little by little in the crank angle direction (horizontal axis direction of a combustion waveform shown in FIG. 7) while keeping the waveform of the reference data fixed. A maximum value $R_{max}$ of the cross-correlation coefficient R in the course of this operation corresponds to the cross-correlation coefficient R when two waveforms are closest to each other overall, and can be expressed as shown in the following equation (5). The first correlation index value $I_{R1}$ used in the present embodiment is not the maximum value $R_{max}$ itself, but rather is a value obtained by performing predetermined normalization processing on the cross-correlation coefficient R. The term "normalization processing" used here refers to processing that is defined so that $R_{max}$ shows a value of 1 when the two waveforms (the respective waveforms of reference data and measured data) are completely matching, and since this processing itself is known, a detailed description thereof is omitted here.

$$R_{max}=\max(R)=\max(\Sigma f_{a-b}(\theta)g_{a-b}(\tau_\theta-\theta)) \quad (5)$$

The first correlation index value $I_{R1}$ calculated by the aforementioned calculation processing becomes 1 (maximum) in an example where the two waveforms completely match, and progressively approaches zero as the degree of correlation between the two waveforms decreases. Note that, in an example where the first correlation index value $I_{R1}$ exhibits a negative value, there is a negative correlation between the two waveforms, and the first correlation index value $I_{R1}$ exhibits a value of −1 in an example where the two waveforms are completely inverted. Accordingly, the degree of correlation between reference data and measured data of MFB can be ascertained on the basis of the first correlation index value $I_{R1}$ that is obtained as described above.

In the example illustrated in FIG. 7, in an example of the measured combustion waveform 1 in which noise is not superimposed, the first correlation index value $I_{R1}$ becomes a large value (a value close to 1). On the other hand, in an example of the measured combustion waveform 2 in which spike-shaped noise is superimposed at a single location, the first correlation index value $I_{R1}$ becomes a small value relative to the value in the example of the measured combustion waveform 1. A situation in which the first correlation index value $I_{R1}$ becomes a small value due to superimposition of noise is not limited to an example where spike-shaped noise is superimposed at a single location, and similarly applies when continual noise is superimposed on the whole of a combustion waveform as in the noise waveform 3 shown in FIG. 6. Further, the first correlation index value $I_{R1}$ decreases as the level of noise that is superimposed increases. Therefore, by previously setting a determination value $I_{Rth}$ (positive value), a judgment as to whether or not noise that exceeds a certain level is superimposed on measured data of MFB can be made based on the magnitude of the first correlation index value $I_{R1}$.

Note that, although according to the present embodiment a configuration is adopted in which, as described above, the maximum value of a value obtained by normalizing the cross-correlation coefficient R is used as the first correlation index value $I_{R1}$, a "correlation index value" according to the present disclosure may also be the maximum value $R_{max}$ itself of the cross-correlation coefficient R that is not accompanied by predetermined normalization processing. This also applies with respect to a second correlation index value $I_{R2}$ that is described later. However, the correlation index value (that is, the maximum value $R_{max}$) in an example that is not accompanied by normalization processing does not simply increase as the degree of correlation increases, but rather the relation described hereunder exists between the size of the maximum value $R_{max}$ and increases/decreases in the degree of correlation. That is, the degree of correlation increases as the maximum value $R_{max}$ increases, and the degree of correlation becomes highest (that is, the two waveforms completely match) when the maximum value $R_{max}$ equals a certain value X. Further, when the maximum value $R_{max}$ increases to a value greater than the value X, the degree of correlation decreases with an increase in the maximum value $R_{max}$. Accordingly, in the example of using the maximum value $R_{max}$ as it is as the "correlation index value" without normalization processing, a determination as to whether or not the "correlation index value" is less than a "determination value" can be performed by the following processing. That is, when the maximum value $R_{max}$ deviates from within a predetermined range that is centered on the value X, it can be determined that "the correlation index value is less than the determination value" and, conversely, when the maximum value $R_{max}$ falls within the aforementioned predetermined range, it can be determined that "the correlation index value is greater than or equal to the determination value".

(Discrimination of Form of Noise Superimposition)

Noise that is superimposed on an output signal of the in-cylinder pressure sensor 30 temporally occurs or steadily keeps occurring. A temporally occurring noise basically corresponds to noise that is incidentally superimposed on an output signal in a combustion cycle and that, in some cases, is incidentally superimposed continuously over a plurality of combustion cycles. One of the causes of occurrence of this kind of noise is use of wireless equipment, such as a mobile phone, in the room of the vehicle in which the internal combustion engine 10 is mounted. In addition, in the present embodiment, noise that is superimposed on an output signal only in a combustion cycle without being superimposed continuously over a plurality of combustion cycles is regarded as a "temporally occurring noise".

On the other hand, noise that keeps occurring over a plurality of combustion cycles due to mainly malfunction of an electric circuit (not shown in the drawings) of the in-cylinder pressure sensor 30 is regarded as a "steadily occurring noise". In the present embodiment, when it is judged as described later that noise has occurred in two combustion cycles that is the current combustion cycle and the preceding combustion cycle at the same cylinder, the noise that is an object of the judgement is regarded as a steadily occurring noise.

As already described, superimposition of noise on measured data can be detected by evaluating the magnitude of the first correlation index value $I_{R1}$ to compare the measured data and reference data of MFB. However, it is difficult to determine whether the noise which has been detected is a temporally occurring noise or a steadily occurring noise by comparing the measured data of MFB in the current combustion cycle (in the following explanation, for convenience, also referred to as "current data") and reference data of MFB.

In the present embodiment, the second correlation index value $I_{R2}$ is utilized as well as the first correlation index value $I_{R1}$ in order to discriminate a temporally occurring noise from a steadily occurring noise. The second correlation index value $I_{R2}$ indicates the degree of correlation between the current data of MFB and measured data of MFB immediately prior thereto (in the following explanation, for convenience, also referred to as "immediately preceding past data"). The "immediately preceding past data" mentioned here corresponds to measured data of MFB that is obtained, at the same cylinder, in a combustion cycle (i.e., the preceding combustion cycle) that is one cycle prior to the combustion cycle in which the current data is obtained. Note that calculation of the second correlation index value $I_{R2}$ can be performed using the aforementioned same method as that for calculation of the first correlation index value $I_{R1}$. In addition, with respect to calculation of the second correlation index value $I_{R2}$, since the current data and the immediately preceding past data of MFB are the object of evaluation, the degree of correlation is evaluated between the two types of measured data of MFB. Therefore, the cross-correlation function utilized in this form can be referred more properly to as an auto-correlation function.

FIG. 8 is a view that represents a relation of the first correlation index value $I_{R1}$ and the second correlation index value $I_{R2}$ with respect to the form of noise superimposition. An example 1 shown in FIG. 8 corresponds to an example in which both of the first correlation index value $I_{R1}$ and the second correlation index value $I_{R2}$ are greater than or equal to a determination value $I_{Rth}$ (that is, an example in which the degree of correlation between the current data and reference data of MFB is high and the degree of correlation between the current data and immediately preceding past data is also high). In the example 1, it can be said that, because the first correlation index value $I_{R1}$ is large, noise is not superimposed on the current data (that is, the measured data in the current combustion cycle). In addition, it can be said that, in the example 1, noise is not superimposed also on the immediately preceding past data that has a high correlation with the current data.

An example 2 corresponds to an example in which, although the first correlation index value $I_{R1}$ is greater than or equal to the determination value $I_{Rth}$, the second correlation index value $I_{R2}$ is less than the determination value $I_{Rth}$ (that is, an example in which, although the degree of correlation between the current data and the reference data is high, the degree of correlation between the current data and the immediately preceding past data is low). In the example 2, it can be said that, because the first correlation index value $I_{R1}$ is large, noise is not superimposed on the current data. On the other hand, it can be said that, because the second correlation index value $I_{R2}$ is small, noise is superimposed on the immediately preceding past data that has a low correlation with the current data.

An example 3 corresponds to an example in which, although the first correlation index value $I_{R1}$ is less than the determination value $I_{Rth}$, the second correlation index value $I_{R2}$ is greater than or equal to the determination value $I_{Rth}$ (that is, an example in which, although the degree of correlation between the current data and the reference data is low, the degree of correlation between the current data and the immediately preceding past data is high). In the example 3, it can be said that, because the first correlation index value $I_{R1}$ is small, noise is superimposed on the current data. In addition, in the example 3, it can be said that, because the second correlation index value $I_{R2}$ is large, noise is also superimposed on the immediately preceding past data that has a high correlation with the current data. In the present embodiment, it is judged that in the example 3 noise is steadily occurring.

An example 4 corresponds to an example in which, although both of the first correlation index value $I_{R1}$ and the second correlation index value $I_{R2}$ are less than the determination value $I_{Rth}$ (that is, an example in which the degree of correlation between the current data and the reference data is low and the degree of correlation between the current data and the immediately preceding past data is also low). In the example 4, it can be said that, because the first correlation index value $I_{R1}$ is small, noise is superimposed on the current data. In addition, in the example 4, it can be said that, because the second correlation index value $I_{R2}$ is small, noise is not superimposed on the immediately preceding past data that has a low correlation with the current data. It can therefore be judged that in the example 4 noise has occurred incidentally in the current combustion cycle, that is, noise has occurred temporally.

(Countermeasure Against Noise which has been Detected)

If the SA-CA10 feedback control and the CA50 feedback control are continued without change irrespective of a fact that the feedback controls are being performed when noise is superimposed on measured data of MFB, there is a possibility that high-accuracy feedback controls cannot be performed. In addition, as described above, noise that is superimposed on an output signal of the in-cylinder pressure sensor 30 includes a temporally occurring noise and a steadily occurring noise. Therefore, it is favorable that a countermeasure against noise which has been detected (that is, a "countermeasure against noise that is superimposed on an output signal of the in-cylinder pressure sensor" according to the present disclosure) is appropriate according to the form of noise that is superimposed.

Accordingly, in the present embodiment, when the first correlation index value $I_{R1}$ is less than the determination value $I_{Rth}$ and the second correlation index value $I_{R2}$ is also less than the determination value $I_{Rth}$ (that is, in the example 4), it is determined that noise is temporally superimposed on the measured data of MFB. Further, following this determination, reflection, in the SA-CA10 feedback control and the CA50 feedback control, of the respective measured CA10 and measured CA50 in the combustion cycle in which the first correlation index value $I_{R1}$ that is used for this determination is calculated is prohibited.

Furthermore, in the present embodiment, it is determined that, when the first correlation index value $I_{R1}$ is less than the determination value $I_{Rth}$ and the second correlation index value $I_{R2}$ is greater than or equal to the determination value $I_{Rth}$ (that is, in the example 3), noise is steadily superimposed on the measured data of MFB. In addition, following this determination, the target SA-CA10 and the target CA50 are changed as a longer term countermeasure than the aforementioned countermeasure against at a time of occurrence of temporal noise (in other words, a countermeasure for a greater number of combustion cycles). More specifically, the target SA-CA10 is changed so that a difference between the measured SA-CA10 and the target SA-CA10 becomes smaller, and the target CA50 is similarly changed so that a difference between the measured CA50 and the target CA50 becomes smaller.

Note that, in the example 2, it can be said that a countermeasure according to the form of superimposed noise has been already taken based on a determination that noise had occurred at a time of noise detection for the preceding combustion cycle.

(Specific Processing in First Embodiment)

Figure 9:
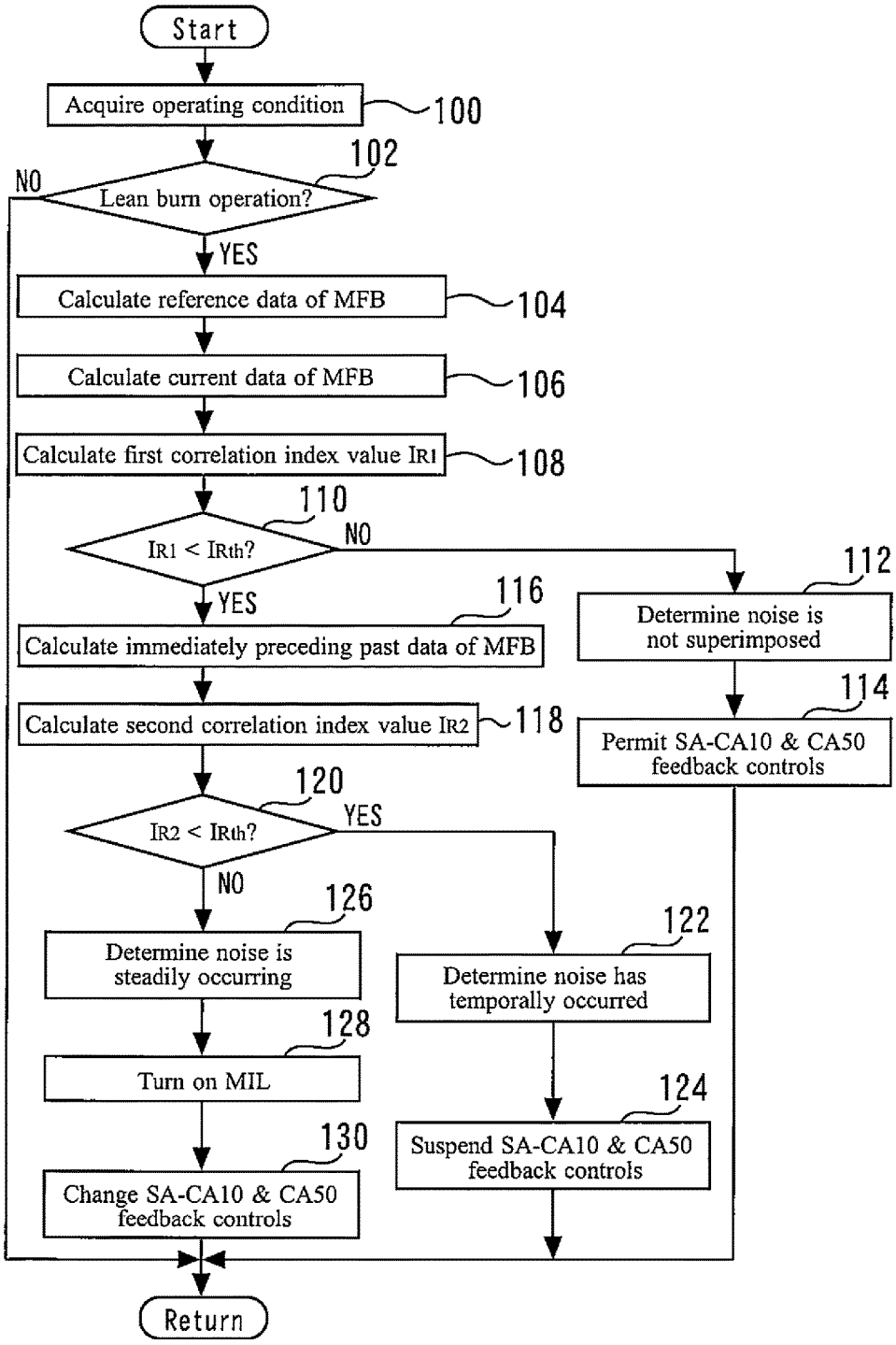
FIG. 9 is a flowchart illustrating a routine that the ECU executes in the first embodiment of the present disclosure.

FIG. 9 is a flowchart illustrating a routine that the ECU 40 executes in the first embodiment of the present disclosure. Note that the present routine is started at a timing at which the opening timing of the exhaust valve 22 has passed in each cylinder, and is repeatedly executed for each combustion cycle.

In the routine shown in FIG. 9, first, in step 100, the ECU 40 acquires the current engine operating condition. The term "engine operating condition" used here refers to mainly the engine speed, the intake air flow-rate, the air-fuel ratio and the spark timing. The engine speed is calculated using the crank angle sensor 42. The intake air flow rate is calculated using the air flow sensor 44. The air-fuel ratio is a target air-fuel ratio, and can be calculated from a map that defines the target air-fuel ratio based on the engine torque and the engine speed. The target air-fuel ratio is either one of a certain lean air-fuel ratio used at a time of lean burn operation and the stoichiometric air-fuel ratio. The spark timing is a command value of a spark timing used in the current combustion cycle (that is, a target spark timing). At a time of operation using the stoichiometric air-fuel ratio, the target spark timing is determined using the intake air flow rate and engine speed as main parameters, while, at a time of lean burn operation, a value in which the CA50 feedback control has been reflected is used as the target spark timing. Note that a target engine torque calculated based on an accelerator position detected by an accelerator position sensor (not shown in the drawings) of the vehicle can, for example, be used as the engine torque.

Next, the ECU 40 proceeds to step 102 and determines whether or not the current operating region is a lean burn operating region. Specifically, it is determined whether the current operating region is a lean burn operating region or an operation region using the stoichiometric air-fuel ratio, based on the target air-fuel ratio acquired in step 100.

When the determination results of step 102 is negative, the current processing of the routine is promptly ended. When, on the other hand, the determination results of step 102 is affirmative, the ECU 40 proceeds to step 104. In step 104, based on the engine operating condition acquired in step 100, reference data of MFB is calculated. The reference data of MFB can be calculated, for example, according to the following equation (6). The calculation of MFB data utilizing equation (6) is a known calculation using a Wiebe function, and hence a detailed description thereof is omitted here. As described in the foregoing, in the present embodiment the calculation period T for calculating the first correlation index value $I_{R1}$ is a crank angle period from the spark timing (target spark timing) (SA) until an opening timing (EVO) of the exhaust valve 22. In present step 104, reference data of MFB is calculated using equation (6) taking the calculation period T as an object.

$$MFB = \left[1 - \exp\left\{-c\left(\frac{\theta - \theta_{min}}{\theta_{max} - \theta_{min}}\right)^{m+1}\right\}\right] \tag{6}$$

Where, in the above equation (6), "c" represents a prescribed constant. Further, "m" represents a shape parameter which be determined from a map in which the shape parameter "m" is previously defined in relation to the engine operating condition (more specifically, the engine speed, the intake air amount, the air-fuel ratio and the spark timing acquired in step 100).

Next, the ECU 40 proceeds to step 106. In step 106, measured data of MFB is calculated, as the current data, in accordance with the above described equation (3) based on measured data of the in-cylinder pressure that is acquired using the in-cylinder pressure sensor 30 in the current combustion cycle.

Next, the ECU 40 proceeds to step 108. In step 108, with the reference data and the current data of MFB that are calculated in steps 104 and 106, respectively, the first correlation index value $I_{R1}$ is calculated using the aforementioned equation (4) by taking as an object the calculation period T.

Next, the ECU 40 proceeds to step 110. In step 110, the ECU 40 determines whether or not the first correlation index value $I_{R1}$ calculated in step 108 is less than a predetermined first determination value $I_{Rth}$. The first determination value $I_{Rth}$ used in present step 110 is set in advance as a value for determining that noise at or beyond a certain level has been superimposed.

If the determination results of step 110 is negative ($I_{R1} \geq I_{Rth}$), that is, if it can be determined that the degree of correlation between the current data (the measured data of MFB of the current combustion cycle) and the reference data thereof at the same operating condition is high, the ECU 40 proceeds to step 112 to determine that noise at or beyond a certain level has not been superimposed. The ECU 40 then proceeds to step 114 to permit the continuance of the SA-CA10 feedback control and CA50 feedback control. More specifically, the measured CA10 and the measured CA50 in the combustion cycle in which the first correlation index value $I_{R1}$ used for the current determination is calculated is regularly reflected on the SA-CA10 feedback control and the CA50 feedback control.

If, on the other hand, the determination results of step 110 is affirmative ($I_{R1} < I_{Rth}$), that is, if it can be determined that the degree of correlation between the current data of MFB and the reference data thereof is low, the ECU 40 proceeds to step 116. In step 116, the measured data of MFB calculated for the preceding combustion cycle at the same cylinder as the cylinder at which the current combustion cycle is performed is obtained as immediately preceding past data. The term of "immediately preceding past data" according to the present disclosure may include not only a measured data of MFB that is calculated, at the same cylinder, in a combustion cycle that is one cycle prior to the combustion cycle in which the current data is calculated as described above, but also a measured data of MFB that is obtained in a combustion cycle of another cylinder during a period from the combustion cycle that is one cycle prior to the combustion cycle until the combustion cycle in which the current data is obtained. For example, when the internal combustion engine 10 is an in-line four-cylinder engine (as one example, firing order is: first cylinder→third cylinder→fourth cylinder→second cylinder) and a combustion cycle in which the current data is obtained is a combustion cycle of the first cylinder, the term "immediately preceding past data" includes measured data of MFB obtained in a combustion cycle of the first cylinder that is one cycle prior to the combustion cycle in which the current data is obtained, and measured data of MFB that is obtained in a combustion cycle of the second cylinder, third cylinder or fourth cylinder that follows the combustion cycle of the first cylinder that is one cycle prior to the combustion cycle in which the current data is obtained. Moreover, it is favorable that the immediately preceding past data used for discrimination of the form of noise superimposition is close to the current data in terms of time. Therefore, it is favorable that, when the immediately preceding past data is data which is calculated at another cylinder other than a cylinder that is an object of calculating the current data, the immediately preceding past data is measured data of MFB that is obtained in a combustion cycle of another cylinder which immediately precedes, in the firing order, the cylinder in whose combustion cycle the current data of MFB is obtained.

Next, the ECU 40 proceeds to step 118. In step 118, with the current data and the immediately preceding past data that are calculated in steps 104 and 116, respectively, the second correlation index value $I_{R2}$ is calculated using the aforementioned equation (6) by taking as an object the calculation period T.

Next, the ECU 40 proceeds to step 120. In step 120, the ECU 40 determines whether or not the second correlation index value $I_{R2}$ calculated in step 118 is less than the aforementioned determination value $I_{Rth}$. When, as a result, the result of determination in step 120 is affirmative, that is, when the first correlation index value $I_{R1}$ is less than the determination value $I_{Rth}$ and the second correlation index value $I_{R2}$ is also less than the determination value $I_{Rth}$ (that is, in the example 4), the ECU 40 proceeds to step 122. In step 122, the ECU 40 determines that noise is temporally superimposed on the measured data of MFB. Further, following this determination, the ECU 40 proceeds to step 124. In step 124, the ECU 40 suspends the SA-CA10 feedback control and the CA50 feedback control.

As already described, the SA-CA10 feedback control and the CA50 feedback control are executed per cylinder during lean-burn operation, the results of these feedback controls (that is, a correction amount that is based on the feedback control) is reflected in the next combustion cycle of the same cylinder. The processing in present step 124 is, more specifically, processing to stop these feedback controls by maintaining a correction amount for the fuel injection amount that is based on the SA-CA10 feedback control and a correction amount for the spark timing that is based on the CA50 feedback control at the previous values thereof, respectively (more specifically, values calculated in the previous combustion cycle), and not reflecting, in the respective correction amounts, the measured CA10 and the measured CA50 calculated in the current combustion cycle. Note that, PI control is utilized as an example of the aforementioned feedback control performed as described with reference to FIG. 3. That is, an I-term (integral term) that utilizes a cumulative difference between a target vale (target SA-CA10 or the like) and a measured value (measured SA-CA10 or the like) is included in these feedback controls. Accordingly, in an example of utilizing the aforementioned difference in a past combustion cycle in order to calculate an I-term when resuming feedback control, it is desirable to ensure that a value in a combustion cycle in which noise is detected is not included.

When, on the other hand, the result of determination in step 120 is negative, that is, when the first correlation index value $I_{R1}$ is less than the determination value $I_{Rth}$ and the second correlation index value $I_{R2}$ is greater than or equal to the determination value $I_{Rth}$ (that is, in the example 3), the ECU 40 proceeds to step 126. In step 126, the ECU 40 determines that noise is steadily superimposed on the measured data of MFB. Subsequently, the ECU 40 proceeds to step 128. In step 128, the ECU 40 judges that malfunction arises at, for example, an electric circuit of the in-cylinder pressure sensor 30 due to superimposition of steady noise and then executes the processing to turn on the MIL 46.

Further, the ECU 40 proceeds to step 130 after executing the processing in step 128. In step 130, the target SA-CA10 and the target CA50 are changed as a long term countermeasure. More specifically, a change of these target values can be, for example, performed as follows. That is, when noise which is detected is temporal, the magnitude of the noise, or a crank angle position on which the noise is superimposed may change in accordance with the form of the current noise. On the other hand, the cause of occurrence of steady noise is conceivable to be malfunction of, for example, the electric circuit of the in-cylinder pressure sensor 30. It is therefore conceivable that, when a plurality of combustion cycles in which noise is steadily occurring are assumed, a similar magnitude of noise is repeatedly superimposed on measured data of MFB at a similar crank angle position in each of the plurality of combustion cycles. Accordingly, it is conceivable that in each of the plurality of combustion cycles the measured SA-CA10 and the measured CA50 are similarly deviated from the target SA-CA10 and the target CA50, respectively.

Accordingly, in present step 130, the ECU 40 calculates the average value of the measured SA-CA10 in the combustion cycle in which the current data is calculated (that is, the current combustion cycle) and the measured SA-CA10 in the combustion cycle in which the immediately preceding past data is calculated (that is, one cycle prior to the current combustion cycle at the same cylinder). In addition, the target SA-CA10 is changed so as to be the same value as the aforementioned average value. With respect to CA50 also, the average value based on the similar manner is calculated and the target CA50 is then changed so as to be the same value as the average value. In this way, according to the processing of present step 130, the target SA-CA 10 is changed so that the difference between the measured SA-CA10 and the target SA-CA10 becomes smaller, and, similarly, the target CA50 is changed so that the difference between the measured CA50 and the target CA50 becomes smaller. Note that, changes of the target SA-CA10 and the target CA50 may be performed in such a manner that the target SA-CA10 and the target CA50 are changed so as to be, instead of the average values, the same values as the target SA-CA10 and the target CA50, respectively, that are used for a combustion cycle in which the current data is calculated. Further, the target SA-CA10 and the target CA50 may be changed so as to be the same values as the target SA-CA10 and the target CA50, respectively, that are used for a combustion cycle in which immediately preceding past data is calculated.

According to the above described processing of the routine shown in FIG. 9, the degree of correlation concerning MFB data is evaluated utilizing not only the first correlation index value $I_{R1}$ that is calculated by taking as an object the reference data and the current data of MFB at the same operating condition, but also the second correlation index value $I_{R2}$ that is calculated by taking as an object the current data and the immediately preceding past data. This makes it possible to detect that noise has been superimposed on measured data of MFB and to determine whether the noise that has been superimposed is temporal or steady.

Further, an appropriate countermeasure in accordance with a form of the superimposed noise can be taken. More specifically, when it is determined that the detected noise is a temporal noise, feedback controls that utilize the current data of MFB (that is, the SA-CA10 feedback control and the CA50 feedback control) are suspended. By this means, a measured CA10 and a measured CA50 in the current combustion cycle with respect to which there is a possibility that an error has arisen due to noise are prohibited from being reflected in the respective feedback controls. It is thereby possible to avoid a situation in which the accuracy of engine control deteriorates due to utilization of the aforementioned measured CA10 and measured CA50. As just described, the countermeasure performed at a time of detecting a temporally occurring noise is to prohibit the current data on which noise is superimposed from being used for the aforementioned feedback controls, and, if noise is not detected in the next combustion cycle thereafter, the feedback controls are reverted to the ones performed as prescribed. This can prevent a long term countermeasure that should be executed at a time of detecting steady occurring noise from being unintendedly executed without being distinguished from the steady occurring noise even if the detected noise is a temporal noise. The occurrence of adverse effects on the engine control due to execution of an inappropriate countermeasure can therefore be avoided. More specifically, for example, if the long term countermeasure is to change the target SA-CA10 as in the countermeasure used in the present embodiment also, adverse effects, such as deterioration of exhaust emissions or a change in engine torque can be prevented from occurring due to changing the target SA-CA10 at a time of the occurrence of a temporally occurring noise in order to correct the air-fuel ratio to a richer side or a leaner side.

Moreover, according to the above described processing of the routine, when it is determined that the noise which has been detected is a steadily occurring noise, the target SA-CA10 and the target CA50 are respectively changed in order to eliminate errors that are steadily produced in the measured CA10 and the measured CA50 due to superimposition of the steadily occurring noise. Here, in various feedback controls including the SA-CA10 feedback control and the CA50 feedback control, accuracy of a target value itself is not always essential, and the target value only has to cause an output of a sensor used for feedback control to correlate with a phenomenon that actually occurs. More specifically, one example is here taken in which a measured SA-CA 10 is steadily greater than a target SA-CA10 by a value Y due to the influence of a steadily occurring noise. In this example, if the target SA-CA10 is increased by the value Y, an error to which the steadily occurring noise affects the SA-CA10 feedback control is eliminated, and appropriate correlation between an output of the in-cylinder pressure sensor 30 and a phenomenon that actually occurs can thereby be obtained. According to this kind of a change of a target value as the countermeasure, when noise is steadily occurring, feedback control can therefore be continued while eliminating the influence to which the noise steadily affects the feedback control.

Furthermore, in the present embodiment, the second correlation index value $I_{R2}$ is calculated using the current data and the immediately preceding past data calculated, at the same cylinder, in a combustion cycle that is one cycle prior to a combustion cycle in which the current data calculated. Because the two measured data at the same cylinder are compared with each other accordingly, the degree of correlation between the current data and the past data can be evaluated while eliminating the influence of combustion variation between cylinders.

Note that, in the above described first embodiment, the ECU 40 that is programmed to: execute the processing in step 106; execute the SA-CA10 feedback control and the CA50 feedback control; execute the processing in step 124 when the determination results of both steps 110 and 120 are affirmative; execute the processing in step 130 when the determination results of step 110 is affirmative and the determination results of step 120 is negative; execute the processing in step 108; and execute the processing in step 118, corresponds to the "controller" according to the present disclosure. In addition, the fuel injection valve 26 and the ignition device 28 correspond to the "actuator" according to the present disclosure; the determination value $I_{Rth}$ corresponds to each of the "first determination value" and the "second determination value" according to the present disclosure; and SA-CA10 corresponds to the "specified parameter" according to the present disclosure.

Second Embodiment

Next, a second embodiment of the present disclosure will be described with reference to FIG. 10.

[Noise Detection Technique and Countermeasure at Time of Noise Detection in the Second Embodiment]

(Countermeasure Against Noise which has been Detected)

In the above described first embodiment, when it is determined that noise is steadily superimposed on measured data of MFB, the target SA-CA10 and the target CA50 are changed as a long term countermeasure. In contrast, according to the present embodiment, when it is determined that noise is steadily superimposed on measured data of MFB, the SA-CA10 feedback control and the CA50 feedback control are suspended, as a long term countermeasure, over a longer period than that when noise is temporally superimposed.

(Specific Processing in Second Embodiment)

Figure 10:
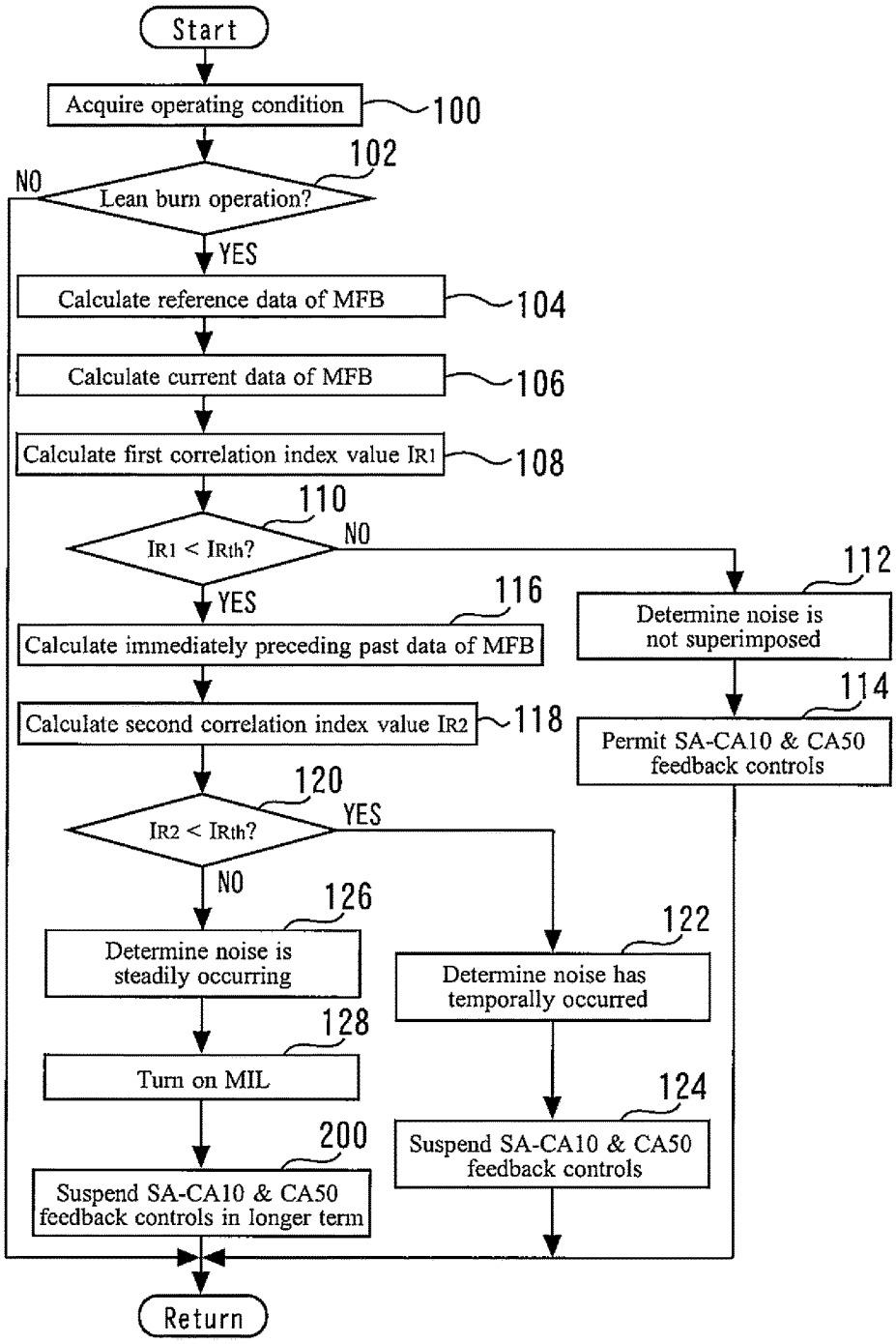
FIG. 10 is a flowchart illustrating a routine that the ECU executes in a second embodiment of the present disclosure.

FIG. 10 is a flowchart illustrating a routine that the ECU 40 executes in the second embodiment of the present disclosure. Note that, in FIG. 10, steps that are the same as steps shown in FIG. 9 in the first embodiment are denoted by the same reference numerals, and a description of those steps is omitted or simplified.

In the routine shown in FIG. 10, the ECU 40 proceeds to step 200 after determining in step 126 that noise is steady occurring and turning on the MIL 46 in step 128 when the result of determination in step 120 is negative. In step 200, the ECU 40 executes, as a long term countermeasure, suspension of the SA-CA10 feedback control and the CA50 feedback control continuously during the current running of the vehicle in which the internal combustion engine 10 is mounted. Note that, after the long term countermeasure is executed in present step 200, the present routine stops starting the processing of the routine since the routine is no longer required in the current vehicle running.

According to the above described processing of the routine shown in FIG. 10, when it is determined that noise is steadily occurring, the SA-CA10 feedback control and the CA50 feedback control are suspended continuously during the current running of the vehicle. On the other hand, if the aforementioned feedback controls are suspended by the processing of step 124 when it is determined that noise has temporally occurred, a period that is subject to the suspension is only a period that is required to pass through one or a plurality of predetermined combustion cycles that utilize the measured CA10 and the measured CA50 calculated in a combustion cycle that is an object of the determination. The number of the predetermined combustion cycles is sufficiently less than the number of combustion cycles performed during one vehicle running. Therefore, according to the aforementioned processing of the routine, when it is determined that the noise is steadily occurring, the aforementioned feedback control is suspended over a longer term relative to that when it is determined that noise has temporally occurred. In other words, when it is determined that the noise is steadily occurring, a period of performing a change of the relevant engine control is made longer. As described so far, according to the countermeasure in the present embodiment performed when a steadily occurring noise is superimposed, in a configuration which has a basic control concept that the aforementioned feedback control is suspended when noise is detected, unnecessary execution of the aforementioned processing of the routine in every combustion cycle can be avoided at a time of noise being steadily occurring. Thus, a decrease in calculation load of the ECU 40 can be realized.

In the above described second embodiment, an example in which the SA-CA10 feedback control and the CA50 feedback control are suspended continuously during one running of the vehicle is taken as a long term countermeasure at a time of noise being steadily occurring. However, a change of engine control that is a countermeasure against noise superimposed on an output signal of an in-cylinder pressure sensor in the present disclosure may be performed with a form other than the aforementioned form, provided that a period in which the change of engine control is performed at a time of noise being steadily occurring is longer than that at a time of noise being temporally occurred (that is, when a first correlation index value is less than a first determination value and a second correlation index value is less than a second determination value). More specifically, when a change of engine control is performed by a predetermined number of combustion cycles as a result of noise temporally occurring, the change of engine control only has to be performed over a greater number of combustion cycles relative to the number of the aforementioned predetermined combustion cycles.

Note that, in the above described second embodiment, the ECU 40 that is programmed to: execute the SA-CA10 feedback control and the CA50 feedback control; execute the processing in step 124 when the determination results of both steps 110 and 120 are affirmative; and execute the processing in step 200 when the determination results of step 110 is affirmative and the determination results of step 120 is negative, corresponds to the "controller" according to the present disclosure.

Third Embodiment

Next, a third embodiment of the present disclosure will be described with reference to FIG. 11.

[Noise Detection Technique and Countermeasure at Time of Noise Detection in the Third Embodiment]

(Discrimination of Form of Noise Superimposition)

The present third embodiment differs from the above described first and second embodiments with respect to a method for discriminating the occurrence of a steady noise from the occurrence of a temporal noise. More specifically, the present embodiment is in common with the first and second embodiments with respect to a point that performs determination using the first and second correlation index values $I_{R1}$ and $I_{R2}$. On the other hand, the present embodiment differs from the first and second embodiments as follows. That is, in the first and second embodiments, it is determined that noise is steady occurring when a determination that the first correlation index value $I_{R1}$ is less than the determination value $I_{Rth}$ and the second correlation index value $I_{R2}$ is greater than or equal to the determination value $I_{Rth}$ is made once. In contrast, in the present embodiment, it is determined that noise is steady occurring when the number of times that the determination that the first correlation index value $I_{R1}$ is less than the determination value $I_{Rth}$ and the second correlation index value $I_{R2}$ is greater than or equal to the determination value $I_{Rth}$ is continuously made over a predetermined number of times N of combustion cycles.

(Specific Processing in Third Embodiment)

Figure 11:
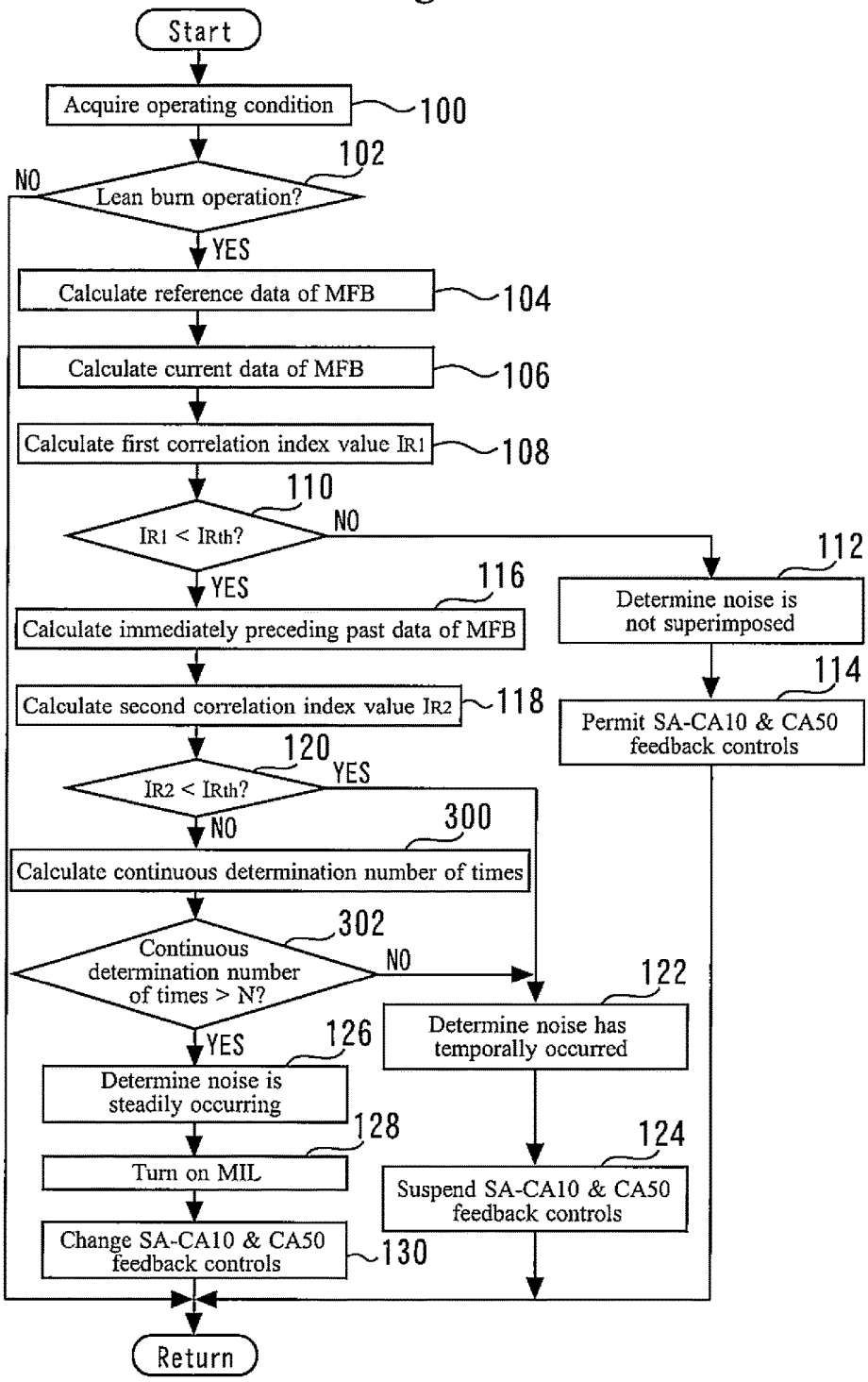
FIG. 11 is a flowchart illustrating a routine that the ECU executes in a third embodiment of the present disclosure.

FIG. 11 is a flowchart illustrating a routine that the ECU 40 executes in the third embodiment of the present disclosure. Note that, in FIG. 11, steps that are the same as steps shown in FIG. 9 in the first embodiment are denoted by the same reference numerals, and a description of those steps is omitted or simplified.

In the routine shown in FIG. 11, the ECU 40 proceeds to step 300 when the result of determination in step 120 is negative. In step 300, the ECU 40 calculates a number of times that the result of determination of step 120 becomes continuously negative (hereunder, also referred to as a "continuous determination number of times".

Next, the ECU 40 proceeds to step 302 to determine whether or not the continuous determination number of times is greater than the predetermined number of times N. In the present embodiment, it is assumed that, when noise is continuously superimposed over a plurality of combustion cycles with a number of times that exceeds the predetermined number of times N (that is, the continuous determination number of times) with respect to combustion cycles at the same cylinder, the noise which has occurred is a steady noise. It is further assumed that, when noise is continuously superimposed with a number of times that is less than or equal to the predetermined number of times N. The predetermined number of times N used in present step 302 is set in advance as a value for discriminating a steadily occurring noise from a temporally occurring noise under the aforementioned assumptions.

When the ECU 40 determines in step 302 that the continuous determination number of times is less than or equal to the predetermined number of times N, the ECU 40 proceeds to step 122 to determine that noise which has been currently superimposed is a temporal noise. When, on the other hand, the continuous determination number of times is greater than the predetermined number of times N, the ECU 40 proceeds to step 126 to determine that noise which has currently superimposed is a steady noise.

In the first and second embodiments, it is determined that noise is steady occurring when a determination (step 120) that the first correlation index value $I_{R1}$ is less than the determination value $I_{Rth}$ and the second correlation index value $I_{R2}$ is greater than or equal to the determination value $I_{Rth}$ is made once. In contrast, according to the above described processing of the routine shown in FIG. 11, it is determined that noise is steady occurring when the continuous determination number of times for the aforementioned determination becomes greater than the predetermined number of times N. As already described in the first embodiment, noise may be superimposed continuously over a plurality of combustion cycles even if the noise is an incidentally occurring noise. According to the processing of the present routine, it can therefore be said that determination on the occurrence of a steady noise can be performed more reliably. As a result, the processing of the present routine makes it much more possible to prevent a long term countermeasure against a steady occurring noise from being unnecessarily executed due to the fact that a temporally occurring noise is erroneously determined as a steady occurring noise.

In the above described third embodiment, the combination of the processing (steps 300 and 302) for evaluating the continuous determination number of times according to the present embodiment with the processing of the routine shown in FIG. 9 according to the first embodiment is taken as an example. However, this processing may be similarly executed in combination with the processing of the routine shown in FIG. 10 according to the second embodiment.

Further, in the above described first and third embodiments, a common determination value $I_{Rth}$ is used for both of the first correlation index value $I_{R1}$ and the second correlation index value $I_{R2}$. However, this determination value need not be a common value. Therefore, separate determination values may be used for a first determination value for the first correlation index value $I_{R1}$ and a second determination value for the second correlation index value $I_{R2}$.

Further, although in the above described first to third embodiments, an example is taken in which the degree of correlation of MFB data is evaluated for each cylinder using a cross-correlation function, a configuration may also be adopted in which evaluation of the degree of correlation of MFB data is executed for an arbitrary representative cylinder as an object, and a predetermined countermeasure is implemented that takes all the cylinders as an object when noise is detected. If, however, this configuration is adopted, comparison between waveforms of measured data of MFB at two cylinders that are adjacent in the firing order cannot be performed. Thus, if an evaluation for the degree of correlation of MFB data is performed taking an arbitrary representative cylinder as an object, it is favorable that discrimination of forms of noise superimposition can be performed on the same cylinder basis as described above.

Moreover, in the first to third embodiments, a cross-correlation function is used to calculate the first correlation index value $I_{R1}$ and the second correlation index value $I_{R2}$. However, a calculation method for the "correlation index value" according to the present disclosure is not necessarily limited to a method using a cross-correlation function. That is, the calculation method may use, for example, a value obtained by adding together the squares of differences (a so-called "residual sum of squares") between the current data and reference data corresponding therewith of MFB at the same crank angles while taking a predetermined calculation period as an object. This also applies with respect to comparison between the current data and the immediately preceding past data. In addition, when the residual sum of squares is utilized, the value decreases as the degree of correlation increases. More specifically, a value that becomes larger as the degree of correlation increases is used for the "correlation index value" according to the present disclosure. Accordingly, where the residual sum of squares is utilized, it is sufficient to use the "correlation index value" as an inverse number of the residual sum of squares.

Further, although the SA-CA10 feedback control and the CA50 feedback control are illustrated in the first to third embodiments, "engine control that controls an actuator of the internal combustion engine based on the measured value of the specified fraction combustion point" according to the present disclosure is not limited to the above described feedback controls. That is, the specified fraction combustion point CAα can be, for example, used for determining torque fluctuations or misfiring of the internal combustion engine. Accordingly, control of a predetermined actuator that is performed upon receiving a result of the aforementioned determination is also included in the above described engine control. Further, the specified fraction combustion point CAα that is used as an object of "engine control" in the present disclosure is not limited to CA10 and CA50, and may be an arbitrary value that is selected from within a range from CA0 to CA100, and for example may be CA90 that is the 90% combustion point. In addition, for example, a combination of a plurality of specified fraction combustion points CAα may be used, such as CA10 to CA50 that is a crank angle period from CA10 to CA50.

Furthermore, in the first to third embodiments, a configuration is adopted in which, at a time of lean-burn operation accompanied by implementation of the SA-CA10 feedback control and the CA50 feedback control, evaluation of the degree of correlation of MFB data is performed based on the first correlation index value $I_{R1}$ and the second correlation index value $I_{R2}$. However, on the premise that engine control based on a specified fraction combustion point CAα is performed, such evaluation is not limited to one performed at a time of lean-burn operation, and, for example, a configuration may be adopted in which the evaluation is performed at a time of the stoichiometric air-fuel ratio burn operation.

What is claimed is:

1. A control apparatus for an internal combustion engine, comprising:

an in-cylinder pressure sensor configured to detect an in-cylinder pressure;

a crank angle sensor configured to detect a crank angle; and a controller, the controller being programmed to:

(a) calculate measured data of mass fraction burned that is synchronized with crank angle, based on an in-cylinder pressure detected by the in-cylinder pressure sensor and a crank angle detected by the crank angle sensor;

(b) calculate, based on the measured data of mass fraction burned, a measured value of a specified fraction combustion point that is a crank angle at which mass fraction burned reaches a specified fraction, and to execute engine control that controls an actuator of the internal combustion engine based on the measured value of the specified fraction combustion point;

(c) calculate a first correlation index value that indicates a degree of correlation between current data of the measured data of mass fraction burned and reference data of mass fraction burned, the reference data of mass fraction burned being based on an operating condition of the internal combustion engine;

(d) calculate a second correlation index value that indicates a degree of correlation between the current data and immediately preceding past data relative to the current data; and (e) perform a change of the engine control when the first correlation index value is less than a first determination value and the second correlation index value is less than a second determination value, wherein the change of the engine control is to prohibit reflection, in the engine control, of the measured value of the specified fraction combustion point in a combustion cycle in which the current data of the mass fraction burned is calculated, or to lower a degree of the reflection in comparison to that when the first correlation index value is greater than or equal to the first determination value.

2. The control apparatus according to claim 1, wherein the engine control controls the actuator so that the measured value of the specified fraction combustion point or a measured value of a specified parameter that is defined based on the measured value of the specified fraction combustion point comes close to a target value, wherein the controller is programmed to execute a countermeasure against noise that is superimposed on an output signal of the in-cylinder pressure sensor when the first correlation index value is less than the first determination value and the second correlation index value is greater than or equal to the second determination value, and wherein the countermeasure is to change the target value so that a difference between the measured value of the specified fraction combustion point or the measured value of the specified parameter and the target value decreases.

3. The control apparatus according to claim 1, wherein the controller is programmed to execute a countermeasure against noise that is superimposed on an output signal of the in-cylinder pressure sensor when the first correlation index value is less than the first determination value and the second correlation index value is greater than or equal to the second determination value, and wherein the countermeasure is to increase a period of performing the change of the engine control when the first correlation index value is less than the first determination value and the second correlation index value is greater than or equal to the second determination value, in comparison to that when the first correlation index value is less than the first determination value and the second correlation index value is less than the second determination value.

4. The control apparatus according to claim 2, wherein the countermeasure is executed when the number of times that a determination that the first correlation index value is less than the first determination value and the second correlation index value is greater than or equal to the second determination value is continuously made becomes greater than a predetermined number of times.

5. The control apparatus according to claim 3, wherein the countermeasure is executed when the number of times that a determination that the first correlation index value is less than the first determination value and the second correlation index value is greater than or equal to the second determination value is continuously made becomes greater than a predetermined number of times.

6. The control apparatus engine according to claim 1, wherein the controller is programmed to calculate the second correlation index value by using, as the immediately preceding past data, the measured data of mass fraction burned that is calculated, at a same cylinder, in a combustion cycle that is one cycle prior to a combustion cycle in which the current data of mass fraction burned is calculated.

7. The control apparatus according to claim 1, wherein the in-cylinder pressure sensor is configured to detect an in-cylinder pressure for each cylinder of a plurality of cylinders, wherein the controller is programmed to calculate the second correlation index value by using, as the immediately preceding past data, the measured data of mass fraction burned that is calculated, at a same cylinder, in a combustion cycle of another cylinder during a period from a combustion cycle that is one cycle prior to a combustion cycle in which the current data of mass fraction burned is calculated until a combustion cycle in which the current data of mass fraction burned is calculated.

8. The control apparatus according to claim 7, wherein the another cylinder is a cylinder that, in a firing order, is positioned one place before a cylinder in whose combustion cycle the current data of mass fraction burned is calculated.

* * * * *